US009234349B1

(12) United States Patent
Daiber et al.

(10) Patent No.: US 9,234,349 B1
(45) Date of Patent: Jan. 12, 2016

(54) CONCRETE PANEL SYSTEM AND METHOD FOR FORMING REINFORCED CONCRETE BUILDING COMPONENTS

(71) Applicant: Convergent Market Research, Inc., Austin, TX (US)

(72) Inventors: Mark Daiber, Houston, TX (US); Clark Isaac Miller, Austin, TX (US); Robert James Tingley, Georgetown, TX (US); Michael Torres, Austin, TX (US)

(73) Assignee: Convergent Market Research, Inc., Austin, TX (US)

( * ) Notice: Subject to any disclaimer, the term of this patent is extended or adjusted under 35 U.S.C. 154(b) by 0 days.

(21) Appl. No.: 14/475,229

(22) Filed: Sep. 2, 2014

Related U.S. Application Data

(60) Provisional application No. 61/959,717, filed on Aug. 30, 2013.

(51) Int. Cl.

| | |
|---|---|
| ***E04B 5/04*** | (2006.01) |
| ***E04B 2/04*** | (2006.01) |
| ***E04C 2/06*** | (2006.01) |

(Continued)

(52) U.S. Cl.
CPC ... *E04C 2/06* (2013.01); *E04B 1/66* (2013.01); *E04B 1/92* (2013.01); *E04C 2/38* (2013.01); *E04C 5/012* (2013.01); *E04B 2/42* (2013.01);
(Continued)

(58) Field of Classification Search
CPC ..... E04B 2/46; E04B 2002/0226; E04B 2002/0228; E04B 2/42
USPC ..... 52/223.5, 223.6, 285.1, 223.7, 282.2, 52/223.13, 277, 278, 592.6, 604, 605, 606, 52/591.3, 583.1, 590.2, 607, 286, 220.2; 405/286
See application file for complete search history.

(56) References Cited

U.S. PATENT DOCUMENTS 1,684,050 A * 9/1928 Adams ..... 52/590.2
2,338,246 A 1/1944 Hoge
(Continued)

FOREIGN PATENT DOCUMENTS

EP 2194213 A1 6/2010
WO 8204273 A1 12/1982
(Continued)

OTHER PUBLICATIONS

Author Unknown, Apr. 9, 2013, frames from an Internet-published video (Facebook Page for GreenWorld Restoration LLC).

*Primary Examiner* — Chi Q Nguyen
(74) *Attorney, Agent, or Firm* — Russell D. Culbertson; The Culbertson Group, P.C.

(57) ABSTRACT

A concrete panel system includes first, second, and third rectangular precast concrete panels, each defining a respective top edge, bottom edge, and first and second lateral edges. A first type connector is formed in the concrete material at least along the top edge of the first panel and along the first lateral edge of the first panel. A second type connector is formed in the concrete material at least along the second lateral edge of the second panel, and along the bottom edge of the third panel. The first type connector and the second type connector are configured to connect together, and a cavity is formed between the respective panel edges. This cavity extends along both the top edge of the first panel and the first lateral edge of the first panel to facilitate positioning reinforcing bar traversing a corner of the first or second panel.

20 Claims, 13 Drawing Sheets

(51) Int. Cl.

| | |
|---|---|
| ***E04C 5/01*** | (2006.01) |
| ***E04C 2/38*** | (2006.01) |
| ***E04B 1/66*** | (2006.01) |
| ***E04B 1/92*** | (2006.01) |
| *E04B 2/42* | (2006.01) |
| *E04B 2/46* | (2006.01) |
| *E04B 2/02* | (2006.01) |

(52) U.S. Cl.
CPC ..... *E04B 2/46* (2013.01); *E04B 2002/0226* (2013.01); *E04B 2002/0228* (2013.01)

(56) References Cited

U.S. PATENT DOCUMENTS

| | | | | |
|---|---|---|---|---|
| 2,803,856 | A | | 8/1957 | Kofahl et al. |
| 2,883,852 | A | | 4/1959 | Midby |
| 3,435,567 | A | | 4/1969 | Tyson |
| 3,449,879 | A | | 6/1969 | Bloom |
| 4,012,871 | A | | 3/1977 | Netto et al. |
| 4,219,978 | A | | 9/1980 | Brown |
| 4,290,246 | A | | 9/1981 | Hilsey |
| 4,472,919 | A | | 9/1984 | Nourse |
| 4,501,098 | A | | 2/1985 | Gregory |
| 4,569,167 | A | | 2/1986 | Staples |
| 4,727,701 | A | | 3/1988 | Figari |
| 5,678,372 | A | | 10/1997 | Thomson et al. |
| 5,771,654 | A | | 6/1998 | Moore et al. |
| 5,865,001 | A | | 2/1999 | Martin et al. |
| 5,871,307 | A | | 2/1999 | Catalano et al. |
| 5,881,524 | A | * | 3/1999 | Ellison, Jr. ..... 52/565 |
| 6,434,900 | B1 | * | 8/2002 | Masters ..... 52/283 |
| 6,625,937 | B1 | | 9/2003 | Parker et al. |
| 7,108,577 | B2 | * | 9/2006 | Peters et al. ..... 446/124 |
| 7,121,061 | B2 | | 10/2006 | Jazzar |
| 7,497,945 | B2 | | 3/2009 | Solomon et al. |
| 7,736,096 | B1 | * | 6/2010 | Aaron ..... 405/284 |
| 7,762,033 | B2 | * | 7/2010 | Scott et al. ..... 52/425 |
| 7,790,302 | B2 | | 9/2010 | Ladely (Guevara) et al. |
| 8,266,862 | B2 | * | 9/2012 | Huang ..... 52/585.1 |
| 8,397,441 | B2 | | 3/2013 | Wallance |
| 8,539,682 | B2 | * | 9/2013 | Mah et al. ..... 30/418 |
| 8,601,758 | B2 | | 12/2013 | Biadora |
| 8,720,160 | B1 | * | 5/2014 | Cooper ..... 52/745.12 |
| 2004/0060739 | A1 | | 4/2004 | Kadaster et al. |
| 2011/0179721 | A1 | | 7/2011 | Barry et al. |
| 2012/0023837 | A1 | | 2/2012 | Eisenbeisz |

FOREIGN PATENT DOCUMENTS

| | | | |
|---|---|---|---|
| WO | 8300716 | A1 | 3/1983 |
| WO | 9527107 | A1 | 10/1995 |
| WO | 9713043 | A1 | 4/1997 |
| WO | 0179619 | A1 | 10/2001 |
| WO | 0202885 | A1 | 1/2002 |
| WO | 2005114495 | A1 | 12/2005 |
| WO | 2006023545 | A2 | 3/2006 |
| WO | 2006032078 | A1 | 3/2006 |
| WO | 2007102830 | A1 | 9/2007 |
| WO | 2009061702 | A1 | 5/2009 |
| WO | 2013052427 | A2 | 4/2013 |
| WO | 2013075023 | A2 | 5/2013 |

* cited by examiner

CONCRETE PANEL SYSTEM AND METHOD FOR FORMING REINFORCED CONCRETE BUILDING COMPONENTS

CROSS-REFERENCE TO RELATED APPLICATION

Applicant claims the benefit, under 35 U.S.C. §119(e), of U.S. Provisional Patent Application No. 61/959,717 filed Aug. 30, 2013, and entitled "Hybrid Wall System Using Steel Framing Modules and Concrete Panels." The entire content of this provisional application is incorporated herein by this reference.

TECHNICAL FIELD OF THE INVENTION

The invention relates to building construction methods including precast concrete panels and especially lightweight concrete panels with reinforcement provided in the connections between the panels.

BACKGROUND OF THE INVENTION

Building walls, retaining walls and perimeter fence-type walls are often made with concrete block. These construction methods are easily done manually, but are time consuming and create a product that has many mortar joints, which are inherently weak. In cases where joints are eliminated by the use of concrete panels, the panels are often massive and require heavy machinery to assemble into the desired structure. If smaller panels are used, it is still necessary to incorporate structural reinforcement within the panel, complicating the panel manufacturing process. What is needed are improved precast concrete panel systems and constructions methods using precast concrete panels.

SUMMARY OF THE INVENTION

The present invention encompasses concrete panel systems, concrete panel assemblies, and methods of producing concrete panel assemblies. The concrete panel systems, assemblies, and methods may be used together with suitable reinforcing bars to form building components comprising walls (including stand-alone walls used as fences), floor structures, and roof structures.

A concrete panel system according to one form of the invention includes first, second, and third rectangular precast concrete panels, each defining a respective top edge, bottom edge, and first and second lateral edges. A first type connector is formed in the concrete material at least along the top edge of the first panel and along the first lateral edge of the first panel. A second type connector is formed in the concrete material at least along the second lateral edge of the second panel, and along the bottom edge of the third panel. The first type connector and the second type connector are configured so that when the first type connector along the first lateral edge of the first panel is placed in a connected position with the second type connector along the second lateral edge of the second panel, and the first type connector along the top edge of the first panel is placed in the connected position with the second type connector along the bottom edge of the third panel, a cavity is formed between the respective panel edges. This cavity extends along both the top edge of the first panel and the first lateral edge of the first panel. The portion of the cavity extending along the first lateral edge of the first panel is adapted to receive at least a lower portion of a first reinforcing bar with an upper portion bent at approximately 90 degrees to the lower portion so as to extend either along the top edge of the second panel or in the portion of the cavity extending along the top edge of the first panel. That is, the connection produced by the two connector types allows the reinforcing bar to be placed in the cavity extending along the first lateral edge of the first panel so that the bar may then traverse a corner of the first or second panel and then extend along the top edge of the first or second panel. In some forms of the invention, each cavity formed in the connections between panels is adapted to receive at least two side-by-side (roughly parallel) extending portions of reinforcing bars, together with a suitable encasement material such as a mortar or non-shrink grout to encase the reinforcing bars in the cavity. Also, a suitable adhesive material may be applied so as to reside in portions of the edge connections external to the respective cavity.

The ability to receive a reinforcing bar in position traversing a corner of the connected panels and encase the reinforcing bar in encasement material produces a very robust connection between adjacent panels of the panel system. The connection in the panel system resists forces such as wind loading and earthquake accelerations that would tend to produce cracks in standard mortar joints between traditional concrete blocks. Furthermore, the concrete panel system may be used to form a wall which may be connected to a wood or metal framed wall via connectors incorporated in the concrete panel edge connections. The hybrid concrete and framed wall system has the structural and other benefits of both the concrete panel wall and framed wall.

A concrete panel assembly according to one or more embodiments is made up of the first, second, and third rectangular precast concrete panels. The panels are positioned in an assembly plane with the first panel adjoining the second panel with the first type connector along the first lateral edge of the first panel in a connected position with the second type connector along the second lateral edge of the second panel, and with the third panel adjoining both the first and second panels with the second type connector along the bottom edge of the third panel in the connected position with the first type connector along the top edge of the first panel and the first type connector along the top edge of the second panel. In this assembled arrangement, a respective edge cavity is formed between the respective adjoined panel edges, so that a respective edge cavity extends along the top edge of the first panel, the top edge of the second panel, and the first lateral edge of the first panel. Also a corner cavity is formed at the junction of the first lateral edge of the first panel and the second lateral edge of the second panel with the bottom edge of the third panel. The panel assembly also includes a length of first reinforcing bar extending along at least a portion of the cavity formed between the first and second panels. The first reinforcing bar is bent at approximately 90 degrees so as to traverse the corner cavity and extend parallel to the top edge of the first panel, either along the tope edge of the first panel or the top edge of the second panel. In the panel assembly, at least a portion of each respective edge cavity is filled with encasement material and at least a portion of each adjoined edge has an adhesive material applied thereon.

According to one form of the invention, a method of constructing a concrete building component includes placing the first, second, and third precast rectangular concrete panels in the assembly plane in the configuration described for the panel assembly above. These placements produce the cavities between the panel edges. As the panels are being placed in the assembled configuration, reinforcing bars are placed in the cavities formed between the panels. At least some of these reinforcing bars traverse a respective corner of a panel and run side-by-side with other reinforcing bars in the respective cavities. Encasement material is applied in the cavities either after the cavities are formed or as the panels are placed together to form the cavities. The encasement material serves to encase the reinforcing bars in the edge connections and help provide a connection between the reinforcing bars and the panels. The construction method may also include applying a suitable adhesive material in portions of the panel edge structure external to the respective cavity to help adhere the panels in their connected position in the panel assembly.

The present invention also encompasses a particular panel edge connection structure with a tongue and groove arrangement which produces the reinforcing bar receiving cavities. This tongue and groove arrangement together with other advantages and features of the invention will be described below in connection with the accompanying drawings.

DESCRIPTION OF ILLUSTRATIVE EMBODIMENTS

Figure 1:
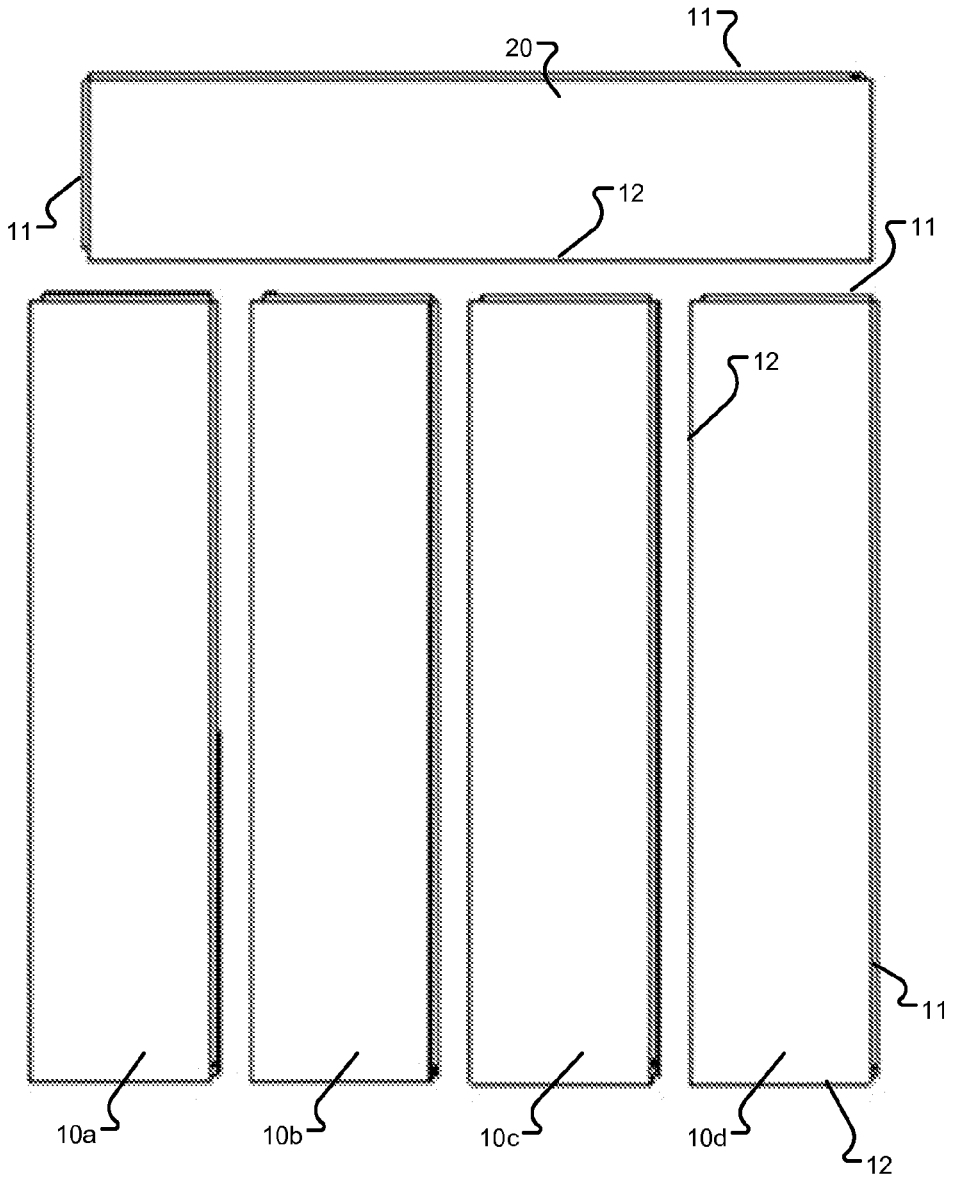
FIG. 1 is an exploded front view showing a number of precast concrete panels according to one example embodiment.

FIG. 1 shows precast concrete panels 10*a-d* and 20 which may be assembled to form a wall according to one example embodiment. It will be appreciated that the invention is not limited to systems or methods for producing walls. Rather, panel systems according to various forms of the invention may be used to produce walls, floor structures, and roof structures. As used in this disclosure and the following claims, the designation "building component" will be used to describe the assembled panel structure which may be produced according to the present invention, and this designation will be understood to encompass building walls, free-standing walls (such as fences), retaining walls, floor structures, roof structures, and the like. Various embodiments of the invention will be described below in the context of a "wall" for the purpose of simplifying the discussion only, and this description in the context of a "wall" is not intended to be limiting. Also, relative terms such as top, bottom, lateral, shallow, and deep, are used in this disclosure and the claims simply to assist in identifying and distinguishing the various components, and these relative terms are not intended to be limiting.

The vertical panels 10*a-d* and horizontal panel 20 shown in FIG. 1 are provided with opposing side, tongue and groove elements in which the tongue is formed by parallel ridges (described in detail below in connection with FIG. 3) and represents a first type connector 11. These ridges of the first type connector 11 are adapted to project into an opposing groove of a second type connector 12. Details of this groove structure will also be described below in connection with FIG. 3. Preferably the connectors are located on three or four edges of the panels 10*a-d* and panel 20 as shown in FIG. 1, but this may vary according to the panel position and use in the final assembly. Panels 10*a-d* can be made with varying widths, lengths, and thicknesses depending on the functional requirements of the intended assembly.

Figure 2A:
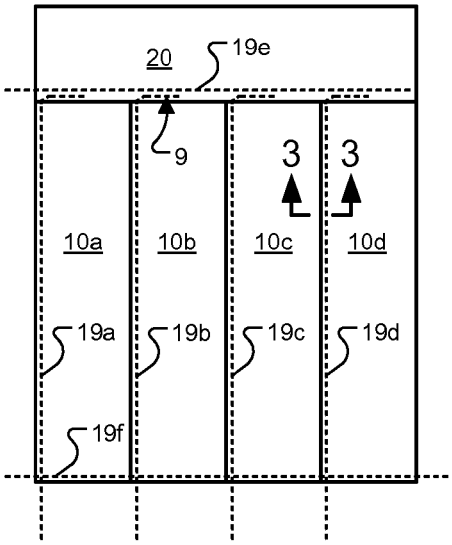
FIG. 2A is a front view of the panels in FIG. 1 assembled with reinforcing bars included in the connections between panels.

FIG. 2A is a somewhat diagrammatic front view of the panels of FIG. 1 in an assembled state in an assembly plane which runs parallel to the plane of the drawing sheet. Panels 10*a-d* are joined with vertical connections to each other, and with a horizontal connection to panel 20 resting at the top of the assembly. There would also be a horizontal connection between the lower edges of the panels 10*a-d* and the support surface on which the panel assembly rests, such as a suitable concrete foundation. Reinforcing bars 19*a-f* employed inside the joints are depicted as dotted lines in FIG. 2A. Reinforcing bars 19*a-d* are shown as projecting below the assembly to indicate that those reinforcing bars can be set in a slab or other foundation or floor assembly under the panels 10*a-d*. Reinforcing bars 19*e-f* run horizontally in the example of FIG. 2A. As can be seen in the drawing, there are several places in the assembly where a connection contains two reinforcing bars overlapping and running adjacent (that is, side-by-side or roughly parallel) to each other in the connection. This arrangement will be described further below with reference to FIG. 2B and FIG. 3, and elsewhere.

Figure 2B:
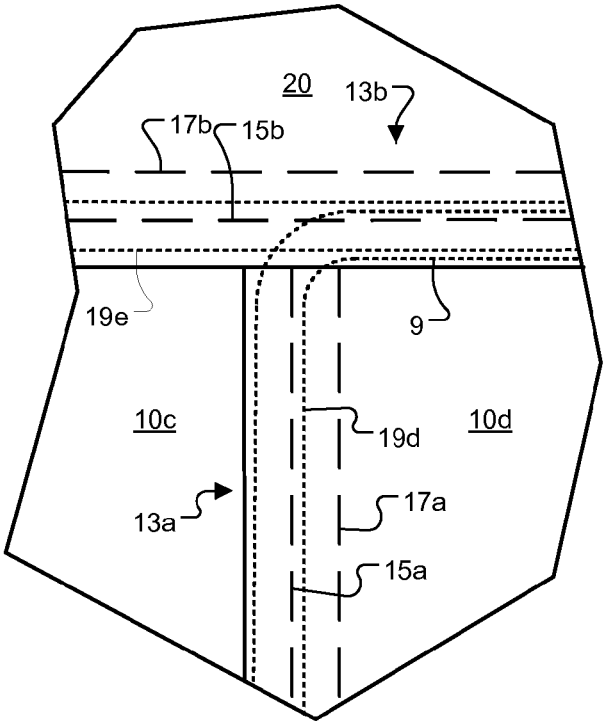
FIG. 2B is an enlarged view of a portion of the panel assembly shown in FIG. 2A, the enlarged view showing a vertical connection between panels and intersecting horizontal connections between panels.

FIG. 2B is an enlarged somewhat diagrammatic view of an edge connection intersection of the embodiment of FIG. 2A showing reinforcing bar 19*d* curved through the connections between panels 10*c*, 10*d*, and 20. This particular connection intersection is selected just as an example of the connection intersections between the vertical panels 10*a-d* and the horizontal panel 20. Reinforcing bar 19*d* extends vertically inside a vertical edge connection cavity 13*a* formed between panels 10*c* and 10*d*, and includes a 90 degree curved section to allow the reinforcing bar to traverse the corner formed at the upper left hand corner of panel 10*d*. A portion 9 of reinforcing bar 19*d* then extends horizontally through cavity 13*b* of the horizontal edge connection between panel 20 and panels 10*c* and 10*d*. This portion 9 of reinforcing bar 19*d* extends side-by-side with reinforcing bar 19*e* in cavity 13*b*. The enlarged view of FIG. 2B shows cavity 13*a* is formed by the tongue and groove connectors formed in the panel edges, and particularly in this embodiment with ridges 15*a* and groove 17*a* formed in opposing panel edges. Similarly, cavity 13*b* is formed by a tongue and groove arrangement provided by ridges 15*b* and groove 17*b*. It is noted that although panels 10*c* and 10*d* are shown with right angle corners at the intersection of their respective top edge and lateral side edge, these intersections may be cast with a curve or a bevel at the corner to help facilitate the traversal of the reinforcing bar around the corner. Also, although not labeled separately in FIG. 2B, it will be appreciated that the intersection of cavity 13*a* and cavity 13*b* produces essentially a corner cavity that facilitates the positioning of reinforcing bar 19*d* around the corner of panel 10*d* (or around the corner of panel 10*c* if it was desired for the bar to extend in that direction).

Figure 3:
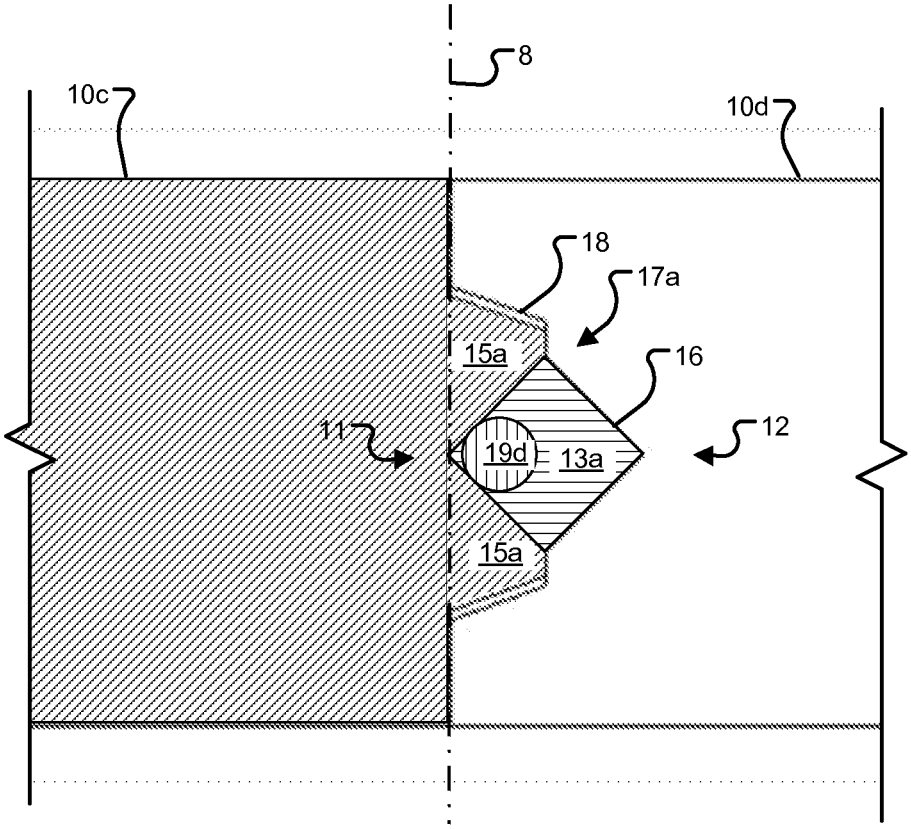
FIG. 3 is an enlarged section view along line 3-3 in FIG. 2A, showing details of connectors formed in the edges of the panels and a cavity formed in the connection to receive reinforcing bars.

The section view of FIG. 3 shows adjacent tongue and groove elements as well as the cavity 13*a* facilitating placement of rebar or reinforcing bar 19*d* according to an embodiment of the invention. First panel 10*c* is illustrated as having a first type connector generally shown at 11 in FIG. 3. First type connector 11 comprises the two spaced-apart ridges 15*a* protruding from a base plane 8 of the first type connector. The two ridges 15*a* define a V-shaped first type connector channel there between, which as shown forms one side of the walls for cavity 13*a* defined between adjacent panels 10*c* and 10*d* in the connected position. That is, the walls of cavity 13*a* are formed in part by the surfaces of the first type connector channel between ridges 15*a*. In this embodiment, the entire first type connector channel resides outside the first type connector base plane 8 (to the right of plane 8 in the figure), however other embodiments may provide a channel between ridges 15*a* which extends past the plane 8 into the structure of panel 10*c*.

Referring still to FIG. 3, second type connector 12 is formed in the edge of panel 10*d* which meets the opposing panel 10*c* edge face on. The second type connector 12 comprises the groove 17*a* recessed inside a base plane of the second type connector. In this particular example the edges of panels 10*c* and 10*d* abut each other such that the base plane 8 of first type connector 11 coincides with the base plane of second type connector 12. Thus both base planes are shown as the plane at reference numeral 8. As will be described in an alternative connector embodiment below, the respective connector base planes need not coincide as shown in the example of FIG. 3. As will also be described below, some embodiments may include a thin layer of adhesive between portions of the panel edges external to the cavity 13*a* and thus the connector type base planes may also not coincide for this reason.

In the embodiment shown in FIG. 3, groove 17*a* of second type connector 12 comprises a first shallow groove 18 and a second deep groove 16 formed along an interior of the first shallow groove 18. Cavity 13*a* defined between adjacent panels 10*c* and 10*d* in the connected position is formed in part by the surfaces of the second deep groove 16. The deep groove 16 in this version is a V-shaped groove having two walls as shown, while the shallower groove 18 in which groove 17 is formed includes slanted walls and an inside face in which deep groove 16 is formed. This is not limiting and actual manufactured shapes may contain smoothly transitioning angles of cast concrete to form the shallow and deeper grooves. Other embodiments may use other groove shapes to form the shallow and deep grooves or may use a single groove which cooperates with ridges 15*a* to form the desired cavity 13*a*. The V-shaped deep groove 16 joining to the V-shaped channel formed by ridges 15*a* in the example shown in FIG. 3 establishes a diamond-shaped cavity 13*a* into which one, two, or more reinforcing bars may be placed.

In some preferred versions of the invention, the panel edge connections as shown in FIG. 3 are of a design, profile, and size such that it is possible to accommodate up to two pieces of #4 rebar in the resulting edge cavity (13*a* in FIG. 3) when the first and second type connectors 11 and 12, respectively, are in the connected position. Thus the example of FIG. 3 shows that reinforcing bar 19*d* fills less than half of cavity 13*a*. In this embodiment, the size of cavity 13*a* allows for at least two reinforcing bars to fit in the cavity side-by-side, and still allow encasement material to flow down the cavity (or otherwise be placed in the cavity) to fill the cavity around the reinforcing bar or bars. The encasement material is indicated by the horizontal section lines in FIG. 3. While in this embodiment only one reinforcing bar 19*d* is shown, other versions use two or even more reinforcing bars in at least portions of the vertical joints. At the junction with the cavity formed between panel 20 and panels 10*c* and 10*d* (for example) each vertically extending length of reinforcing bar may be one bent in a different direction.

Some forms of the present invention may include a suitable adhesive in the connections between adjacent panel edges to help hold the panel edges in the desired connected position. For example, a suitable adhesive may be applied along respective adjacent edges of the two panels external to the surfaces defining the reinforcing bar receiving cavity 13*a* in FIG. 3. The particular first and second type connector arrangement shown in FIG. 3 includes a predefined gap between the outer surface of each ridge 15*a* and the surface of shallow groove 18 to provide space for retaining a suitable amount of adhesive in the connection. Adhesive may also be applied to closely abutting surfaces in the connection such as the surfaces of the panel edges external to the ridges 15*a* for panel 10*c* and shallow groove 18 (again using the example of FIG. 3). In any case, the adhesive may be applied prior to bringing the opposing panel edges together in the desired connected position.

Panels 10*a-d* and 20 may be manufactured (precast) in molds by any suitable molding technique. Preferably the concrete is selected to create panels between 40 and 90 pounds per cubic foot, enabling construction techniques disclosed herein to be accomplished with two construction personnel lifting and assembling the panels to create walls and other structures. This may be accomplished with a suitable known lightweight concrete or "foamcrete" techniques which involve casting concrete with air bubbles or fillers to create a lighter weight structure than typical concrete. Heavier weight concrete, 150 pound per cubic foot concrete for example, may also be used to form panels within the scope of the invention. The panels 10 may have various texture applied to selected faces of the panel by either casing on a profiled surface or applying the texture after the panel has been cast. The profile surface can be part of the mold or part of the supporting surface. Further, the panel may be colorized during the casting process or colored after it has been casted. The panels can be reinforced during the casting process, with material inserted before or during the pouring process, however, some embodiments do not employ reinforcing inside the panels or use only light reinforcing, and rely on the reinforcing bars positioned in the edge connections to provide strength to the finished assembly of panels.

Figure 4:
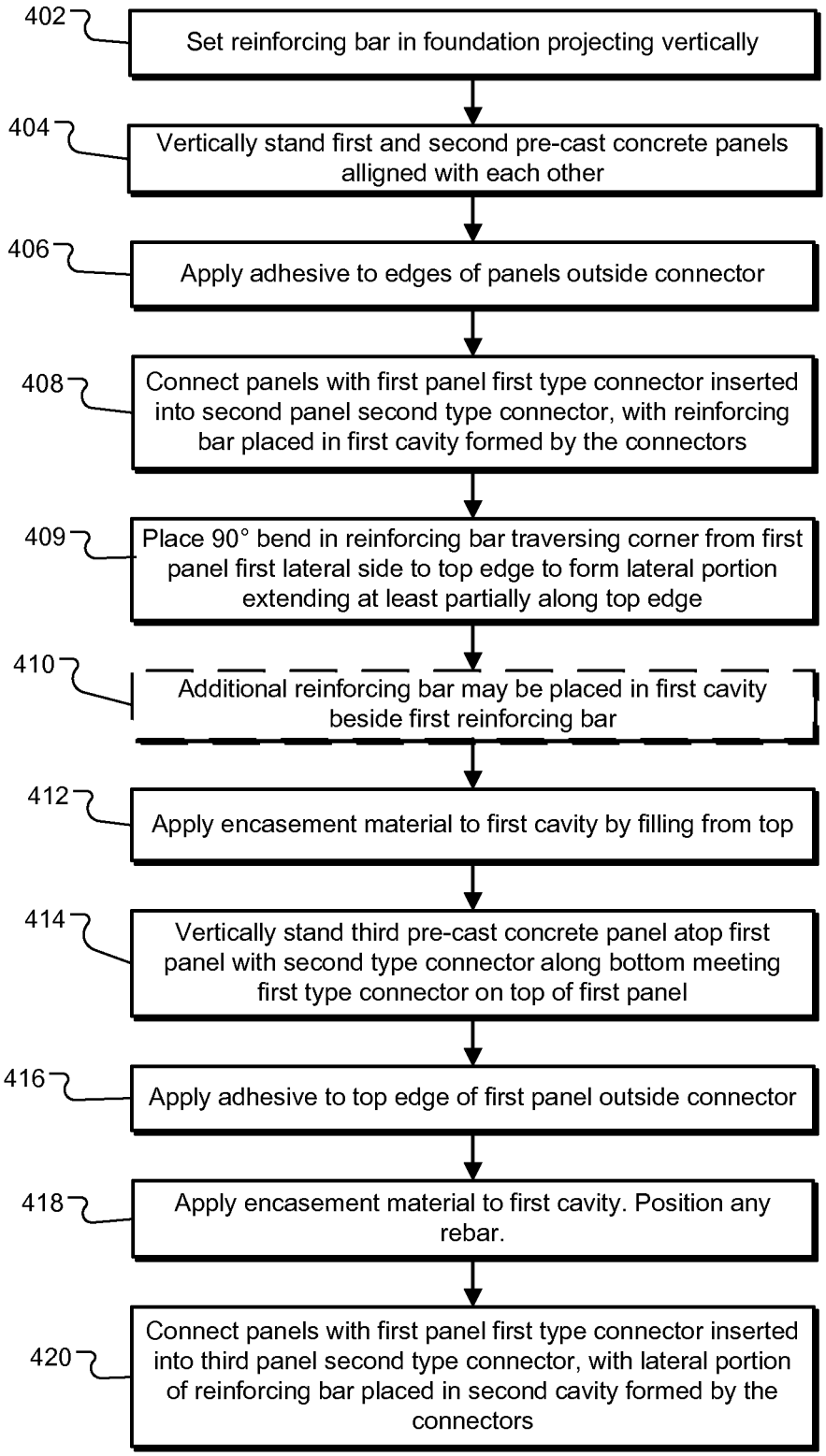
FIG. 4 is a flow chart of an assembly process according to an example embodiment.

FIG. 4 shows a process flowchart for assembling a panel system according to one embodiment. The illustrated process may be used, for example, to assemble three panels on a foundation, in an arrangement such as that in FIG. 2B. The techniques herein are repeated and combined to create larger structures such as building walls for example. The process begins at step 402 where the reinforcing bar (such as 19*d* in FIG. 2A) is set in the foundation by any suitable method (such as during the foundation pour or by affixing the reinforcing bar in a drilled hole in the foundation concrete). With the reinforcing bar extending vertically in the desired position, at step 404 the process for forming a wall vertically stands two precast panels (10*c* and 10*d* in FIG. 3 for example) aligned with each other in an assembly plane, with the first type connector (11 in FIG. 3) facing the second type connector (12 in FIG. 3), preferably with the vertical reinforcing bar positioned between the ridges of the first type connector (15*a* in FIG. 3). Preferably this step can be done by two personnel lifting the panels and placing them by hand, but machine lifting may also be used. An additional reinforcing bar may be inserted in the cavity (13*a* in FIG. 3) or set in place to put multiple reinforcing bars in the joint as discussed above and shown at step 710. Referring to step 406, an adhesive may be applied to the opposing panel edges and the connector surfaces outside the cavity wall portions (of cavity 13*a* in FIG. 3 for example). Various embodiments use different arrangements of adhesive as further discussed below. Next at step 408, the panels are connected by pushing them together such that the first panel first type connector 11 is placed in a connected position with the second panel second type connector 12, with the reinforcing bar placed in the cavity formed by the connectors. The process is designed in preferred versions to allow personnel to push the panels in place by hand such that the adhesive seal and connection is formed along the length of the joint on the panel 10 edge portions external to the surfaces forming the cavity in the connection. The process at step 409 also places a 90 degree bend in the reinforcing bar to traverse a corner defined at the top of the respective panel. The 90 degree value given here (and referenced elsewhere in this disclosure and the claims) is an approximate value as allowed by tolerances to facilitate placement in the connection cavities as described. Traversing the corner in either direction in the plane in which the panels are assembled places a portion of the reinforcing bar extending generally parallel to the top edge of the respective panel. The reinforcing bar may be pre-bent or bent in situ in the vertical cavity. Where two reinforcing bars are used in the vertical joint between adjacent panels, the second bar may run vertically to reinforce additional panels placed atop the current assembly, or may be bent the opposite direction as the other reinforcing bar. At step 412, the process includes adding encasement material into the vertical cavity (13*a* in 2B and FIG. 3 for example), preferably (but not necessarily) by filling from the top and packing down to ensure there are no voids around the reinforcing bar(s) in the cavity.

After the encasement material is applied, the vertical edge connection cavity of two side-by-side panels is complete, and a third panel (such as panel 20 in FIGS. 1 and 2B) may be placed atop the lower assembly. Depending on the desired structure the third panel may be placed horizontally spanning two or more vertical panels (such as 10*c* and 10*d* in FIGS. 1-3). At step 414, the process vertically stands a third precast rectangular concrete panel in a position at least partially atop the first panel in the assembly plane. The third panel has a second type connector (such as connector 12 shown best in FIG. 3) formed in the bottom edge, and connectors formed on other edges as needed for the desired structure. Step 416 applies adhesive to the joint, which may occur before the third panel is stood in place, or after by tilting the panel and applying adhesive into the resulting gaps. The encasement material is applied into the horizontal joint at step 418, which may be done again before or after placement of the panel in the connected position between the opposing connectors. A preferred method fills the first type connector channel atop the first panel with encasement material before standing the third panel atop the connector. The encasement material may have properties to allow mounding sufficiently above the first type connector channel to facilitate filling the horizontal cavity formed by the edge connection. Reinforcing bar may be placed along the horizontal connection at this step if desired in addition to the existing rebar that was positioned over the top of the first panel or second panel at step 409. Next at step 420, the process connects the panels, moving them into final position by placing the first type connector of the first panel in a connected position with the second type connector of the third panel, thereby forming the cavity (cavity 13*b* in FIG. 3 for example) that encloses the reinforcing bar. This structure is sealed by the adhesive that was applied outside the connector cavity and by the encasement material inside the connector cavity. Additional encasement material may be pushed into the cavity from both lateral sides of the cavity to fill it as completely as possible. It can be understood that vertical and horizontal edge connections have been disclosed which may be used in repeated combination to build larger structures such as building walls.

While generally the embodiment of FIGS. 1-3 provides panels of uniform thickness preferably about 6 feet in length by 2 feet in width in order to be installed manually, other embodiments provide for increasing panel thicknesses when additional strength and stability is required. In these cases, the tongue and groove edge connection design remains consistent. Other embodiments vary the lengths and widths of individual panels. Further, alterations to any fixed mold dimension are accomplished by blocking a portion of the filled mold cavity to accomplish desired structures. This is especially helpful when addressing panels for placing in proximity to windows and doors.

The example shown in FIGS. 1-2A includes panels with edge connectors formed along each edge to form the desired edge connections. In particular, each panel 10*a*-*d* includes first type connectors 11 along a first lateral edge and top edge, and second type connectors 12 along a second lateral edge and bottom edge. Panel 20 includes second type connectors along the bottom and second lateral edge, and the first type connector 11 along the first lateral edge and top edge. In some forms of the invention, panels adapted to rest on a foundation (or floor structure) may have a flat bottom edge, or some other edge profile to facilitate a desired connection to the foundation. Similarly, an upper panel such as panel 20 in FIG. 1 may include a flat or other upper edge rather than an edge connector according to the present invention. Also, the edge connectors may be reversed within the scope of the invention such that the first type connector represents the groove connector of the tongue and groove arrangement and the second type connector represents the tongue connector of the tongue and groove arrangement.

It should be noted that the diamond-shaped cavity 13*a* shown in FIG. 3 represents simply one preferred edge connection cavity profile and the present invention in not limited to this diamond-shaped cavity. An edge connection cavity within the scope of the present invention may be circular or any other shape. Furthermore, an edge connection cavity according to the invention may be larger than shown in FIG. 3 to accommodate additional reinforcing bar, or smaller to accommodate smaller reinforcing bar.

In this disclosure and the following claims, the material used to fill the edge connection cavities such as cavity 13*a* in FIG. 3 is referred to as "encasement material." The invention encompasses any suitable encasement material to fill the respective cavity as desired and encase the reinforcing bars. For example, a suitable mortar may be used particularly in edge connection cavities that extend horizontally. A suitable non-shrink grout may be used particularly to fill edge connection cavities that extend vertically. In some cases the same encasement material may be used in all edge connection cavities for a given panel assembly, while in other cases different encasement materials may be used in different cavities in a given panel assembly. The invention is not limited to any particular encasement material encompasses the use of cement-based and other mortars and grouts with or without additives such as polymers.

Figure 5:
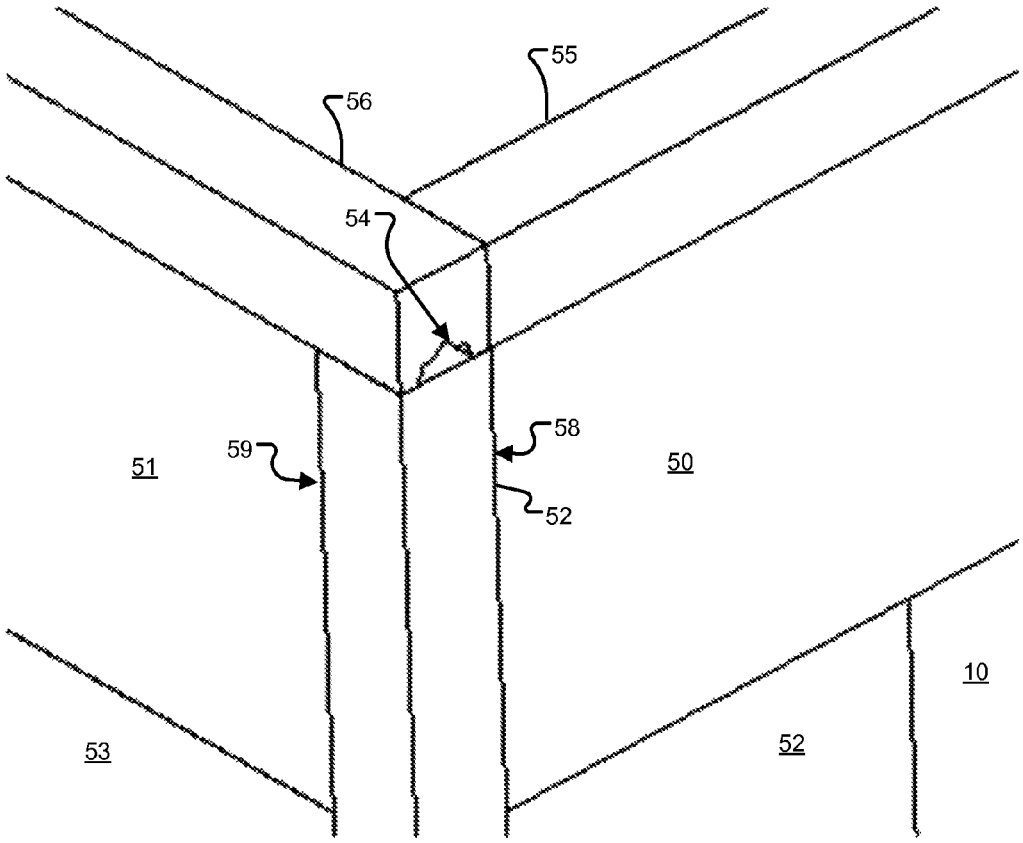
FIG. 5 is a perspective view of the top corner of two wall panels, with corner and cap elements that tie the panels together according to another embodiment.
Figure 6:
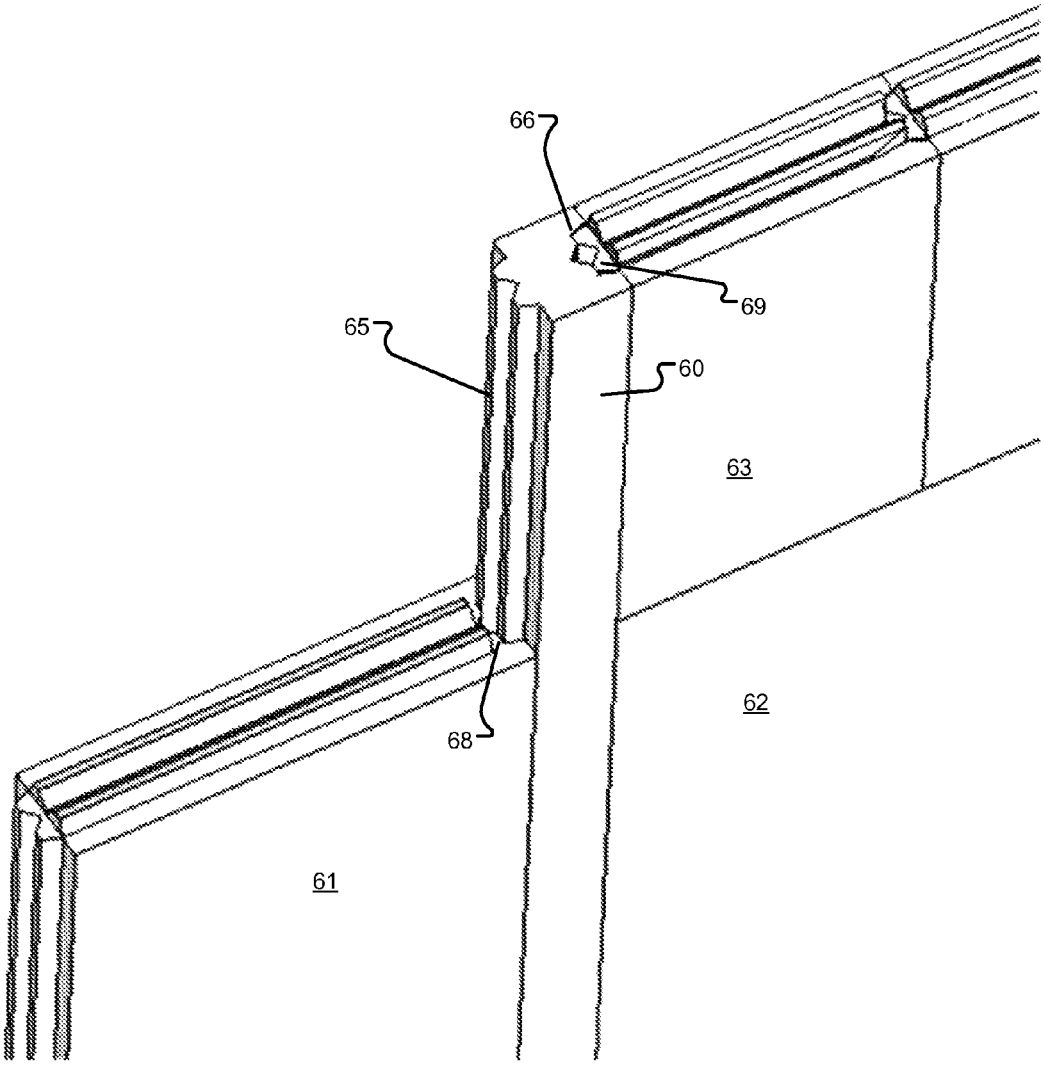
FIG. 6 is a perspective view of and assembled wall incorporating column elements employing a tongue and groove connection according to the present invention.

FIGS. 5 and 6 show embodiments which include additional structural elements between adjacent panels in parts of a complete assembly. FIG. 5 is a perspective view of the top corner of wall panels 50, 51, 52, and 53, showing corner column 52 and cap elements 55 and 56 that tie the wall panels together at a corner according to one embodiment. Wall panels may be panels such as panels 10*a-d* and 20 described above. Corner column 52 may comprise a structural reinforcement member preferably cast in high strength concrete (3000-4000 psi concrete) as discussed below. Cap elements 55 and 56 may also be reinforced, high strength concrete. FIG. 6 is a perspective view of a side column 60, assembled together with panels 61, 62, and 63. Panels 61, 62, and 63 may comprise panels such as panels 10*a-d* and 20 described above, while side column 60 comprises a structural element preferably cast in high strength concrete with or without internal reinforcing such as reinforcing bars or cages.

As shown in FIG. 6, side column 60 includes the same connector arrangement used on the adjacent panels 61, 62, and 63. In particular, side column 60 includes a first lateral edge having a first type connector 55 and a second lateral edge having a second type connector 56. These connectors 65 and 66 may correspond to the first and second type connector 11 and 12, respectively, shown particularly in FIG. 3. Adjacent panels 61, 62, and 63 in FIG. 6 include corresponding edge connectors so that connector 65 of side column 60 may be placed in a connected position with a corresponding second type connector 68 on the opposing edge of panel 61 and connector 66 of the side column may be placed in a connected position with a corresponding first type connector 69 on panel 63 (and a similar second type connector on panel 62 although not shown in the perspective of FIG. 6). Although not shown in the perspective of FIG. 5, a similar connector arrangement is used with corner column 52 and cap elements 55 and 56. Thus corner column 52 may include a first type connector (corresponding to connector 11 in FIG. 3) along edge 58 and a second type connector (corresponding to connector 12 in FIG. 3) along edge 59. These connectors make a connection with complementary edge connectors on the opposing edges of panels 50, 51, 52, and 53 similar to the connection arrangement described above in connection with FIG. 3 for example. Both cap elements 55 and 56 in FIG. 5 may include a second type connector 54 (which may be the connector 12 shown in FIG. 3) adapted to mate with a complementary connector on the top edge of panels 50 and 51.

Thus FIGS. 5 and 6 show how panels may be joined together at the sides, corners, and on the top with structural concrete elements (columns 52 and 60, and cap elements 55 and 56) that are cast with traditional weight, high strength concrete, yet are still light enough to be installed manually because they are much narrower compared to the panels 50-53 and 61-63. These structural concrete elements connect to adjacent panels in the same fashion as the connection between panels described above in connection with FIGS. 1-3. Thus edge connector reinforcing bars may be included in the connection cavities (corresponding to cavity 13*a* in FIG. 3 for example) between the high strength concrete elements and adjacent panels and tied in to the other edge connector reinforcing bars to form a high performance building component.

The columns and cap elements shown in FIGS. 5 and 6 are described above as "structural" elements because they may be cast from high strength concrete as described above and thus may be used to improve the structural performance of a panel assembly according to the present invention. However, it should be born in mind that the panels such as example panels 10*a-d* and 20 described in connection with FIGS. 1-4 are themselves preferably structural, or at least produce a structural assembly in that the resulting assembly may be used to provide structural support for building elements such as roofing structures. Accordingly, although a given element, such as panel 20 may be labelled here as a "panel," it may function as beam or a column in a given assembly. Also, the column elements, particularly corner 52 need not be structural elements according to this definition (since the wall panels themselves may be structural).

Panels such as panels 10*a-d* and 20 shown in FIGS. 1-3, and the additional panels and column and cap elements shown in FIGS. 5 and 6, may incorporate any suitable reinforcing bars, mesh, or other material in their interior. The reinforcing material may be arranged as straight bar or may be formed into suitable cages for casting in the panel concrete.

Figure 7:
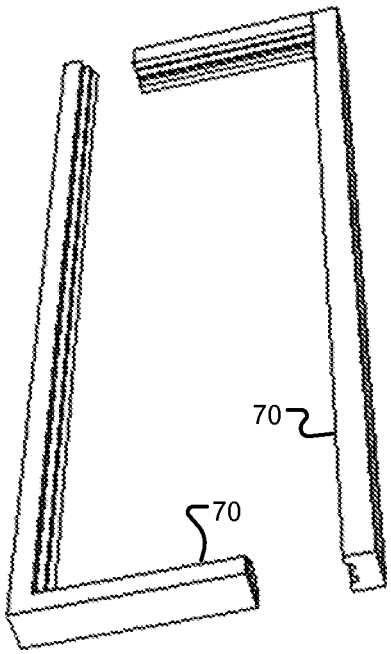
FIG. 7 is a perspective exploded view of a mold for use in casting concrete panels with edge connectors according to the present invention.

FIG. 7 is a perspective exploded view of a "window frame" style mold made up of two "L" shaped mold sections 70. The mold sections 70 may be connected together by suitable means to form a mold for casting concrete panels according to the present invention such as panels 10*a-d* in FIGS. 1 and 2A. In particular, mold sections 70 include edge structures for forming the first and second type connectors such as connector 11 and 12 shown in FIG. 3. Manufacturing panels using the mold shown in FIG. 7 allows for horizontal casting of the panels and post and cap precast process, offering a variety of surfaces for product differentiation. The pouring surface can be flat and smooth, or it can include a variety of textured surfaces. The top surface can be hand screeded for a relatively smooth surface, or it can be overlaid with a textured surface. This manufacturing system also provides for the rapid recycling of forms, whereby the panel can be stripped from the mold in a diagonal fashion, and yet remain in place for further curing.

Figure 8:
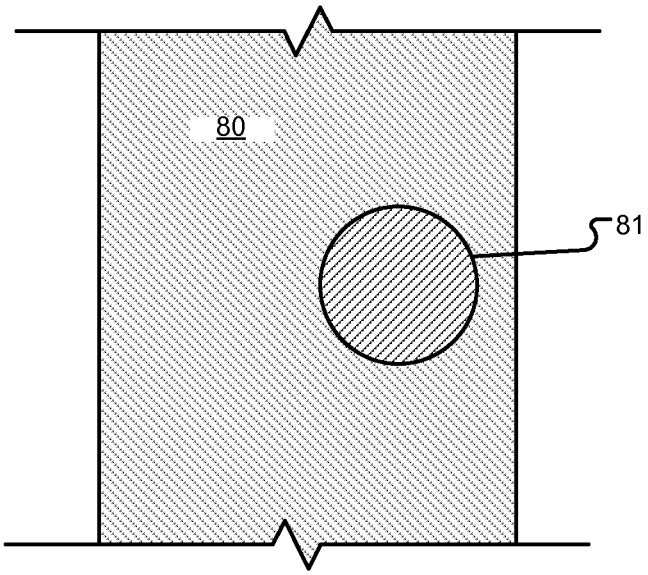
FIG. 8 is a cross sectional view of a panel according to another embodiment with a utility void cast therein.

Another embodiment provides a panel cast with plumbing services in place. FIG. 8 is a cross sectional view of a panel according to such an embodiment, with the panel 80 cast with a plumbing pipe 81 embedded therein. Other embodiments may provide electrical conduits and other passages and structures precast into the panels in place of or in addition to pipe 81. One preferred embodiment provides panels with vertical electrical conduits cast therein, and pull lines placed in the conduits to speed electrical wiring on the construction site. In this embodiment, the conduits are precast in designated vertically oriented panels such as panels 10*a-d* in FIG. 1, with matching conduits precast in panels 20 in FIG. 1. Caps such as 55 and 56 in FIG. 4 may also include openings cast therein to allow electrical wiring to pass all the way from ceiling level to outlet boxes cast in the panels.

Still other embodiments provide panels cast with openings to insert a window. Further embodiments may provide panels cast in such a way to create an opening of a size and shape that when two panels are placed side by side, a window can be inserted in the opening. The same technique provides that a panel can be cast in such a way to create an opening so that when two panels are placed side by side, a door can be framed into the opening. Alternatively, end posts (not shown) may be connected along the free edge of two spaced apart panels (such as panels 10*a-d* in FIG. 1) and the area between the two posts may provide room to frame a door. These end posts would be similar to post 60, but with a suitable connector (such as connector 11 or 12 shown in FIG. 3) is formed in the concrete on only one lateral side to form the desired connection to the panel.

Figure 9:
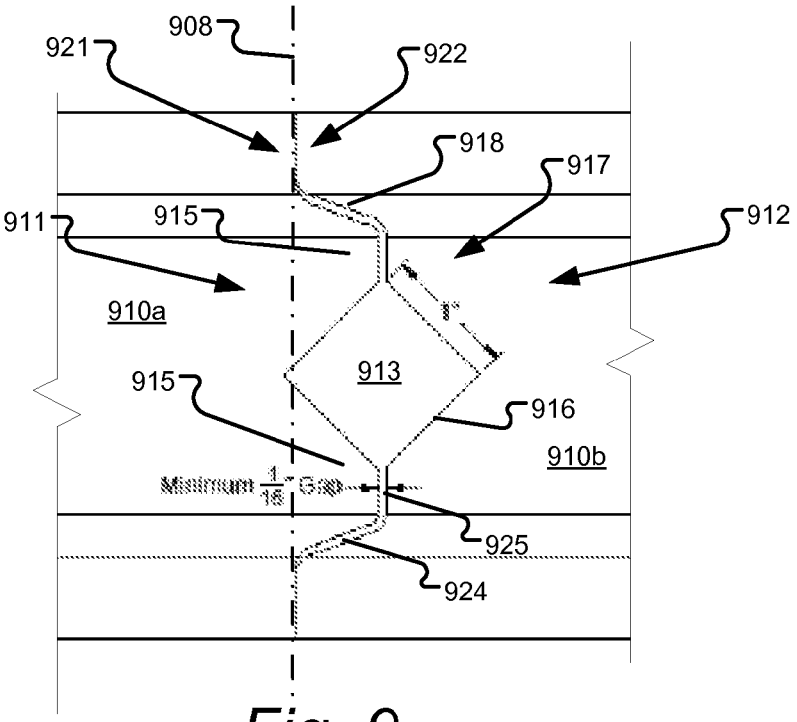
FIG. 9 is a view in section through an alternative panel edge connector structure according to another embodiment.
Figure 10:
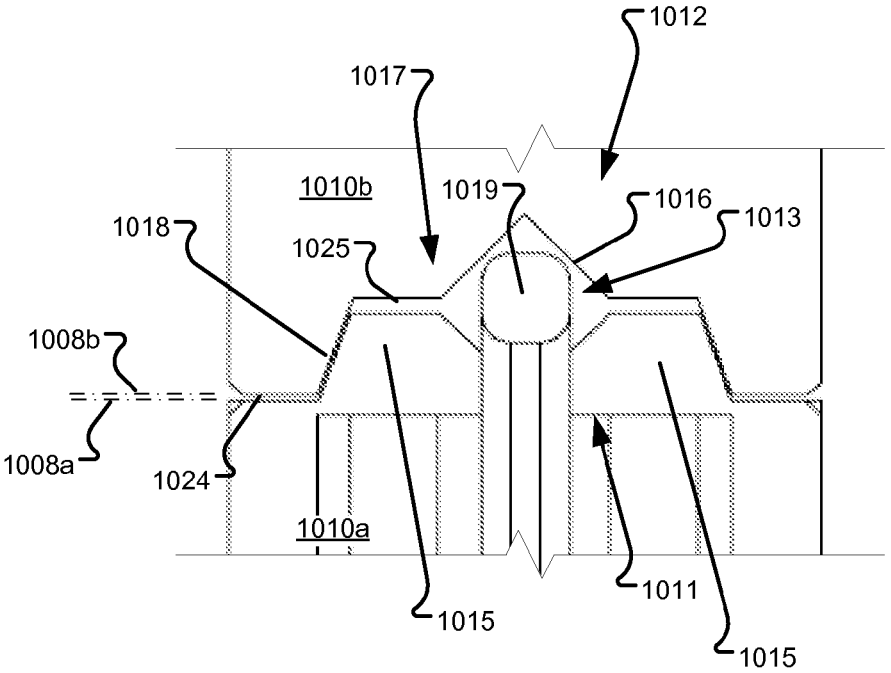
FIG. 10 is a view in section through another alternative panel edge connector according to a further embodiment.

FIGS. 9 and 10 show alternate arrangements for the tongue and groove connection between adjoined panels within the scope of the present invention. Referring first to FIG. 9, the first type connector 911 in this embodiment is formed on a panel 910*a* and includes ridges 915 which protrude from a base plane 908 of the first type connector. The portion of the first type connector 911 defining base plane 908 provides a shoulder 921. As with the previously described embodiments, ridges 915 define a V shaped channel there between. FIG. 9 also shows a second type connector 912 formed in the concrete making up another panel 910*b*. As in the previously described embodiments, the second type connector 912 includes a groove 917 made up of a shallow groove 918 and a deep groove 916 formed in the shallow groove. Groove 917 is recessed from the base plane 908 of the second type connector, with the portion of the second type connector lying in the base plane providing a shoulder 922 adapted to abut the shoulder 921 of the first type connector when the connectors are in the illustrated connected position. The surfaces of deep groove 916 form a first portion of a cavity 913 in the connection between the first type connector and second type connector, while the channel between ridges 915 forms another portion of the cavity.

In the embodiment shown in FIG. 9, when the first type connector 911 is placed in the connected position with the second type connector 912, a first narrow gap 924 is left between a surface of shallow groove 918 and a facing side surface of one of ridges 915. This first narrow gap 924 is illustrated as being present adjacent the outside surface of each ridge 915. A second narrow gap 925 resides in the adjoined panels 910*a* and 910*b* between a top surface of each ridge 915 and a facing surface of shallow groove 918, again on both lateral sides of the connection on either side of cavity 913. Gaps 924 and 925 in this embodiment provide areas for a defined layer of adhesive (not shown in FIG. 9) in the connection to assist in maintaining the connection between the panels. It will be noted that the abutting shoulders 921 and 924 define the width dimension of gaps 924 and 925. It should also be appreciated that the dimensions shown in FIG. 9 are shown only for purposes of example, and are not intended to be limiting.

Although no reinforcing bars are shown in FIG. 9, cavity 913 provides space for receiving one, two, or perhaps more lengths of reinforcing material such as reinforcing steel bar (rebar). As with the cavity 13*a* illustrated in FIG. 3, at least a portion of cavity 913, and preferably the entire length of the cavity is filled with a suitable encasement material to set the reinforcing bar or bars in place.

FIG. 10 shows another embodiment of a first connector type 1011 associated with panel 1010*a* and a second connector type 1012 associated with panel 1010*b*. As with the previously described embodiments, the first type connector includes two ridges 1015 protruding from a base plane 1008*a* of the first type connector and defining a V-shaped channel there between, and the second type connector includes a groove recessed from a base plane 1008*b* of the second type connector. In this particular embodiment, the first type connector base plane 1008*a* is separated slightly from the second type connector base plan 1008*b* when the connectors are in the connected position. Second type connector 1012 has a groove 1017 includes a shallow groove 1018 and a deep groove 1016. The space between deep groove 1016 and the channel formed between ridges 1015 defines the reinforcing receiving cavity 1013. As in previously described embodiments, cavity 1013 is adapted to receive a reinforcing bar 1019 and perhaps additional reinforcing bars.

In the embodiment shown in FIG. 10, it is contact between the outside edges of ridges 1015 and the inside edges of shallow groove 1018 which defines the connected position between the two connector types. That is, contact between the inside edges of shallow groove 1018 and the outside edges of ridges 1015 control how closely the two connector types may be brought together. In the connected position shown in FIG. 10, a small gap 1024 is left between the surface of the first type connector lying in base plane 1008*a* and the surface of the second type connector lying in base plane 1008*b*. Gaps 1025 are also left between the distal surfaces of ridges 1015 and the bottom surfaces of shallow groove 1018. All of these gaps provide areas for adhesive material to help hold the adjoined panels together.

Figure 11:
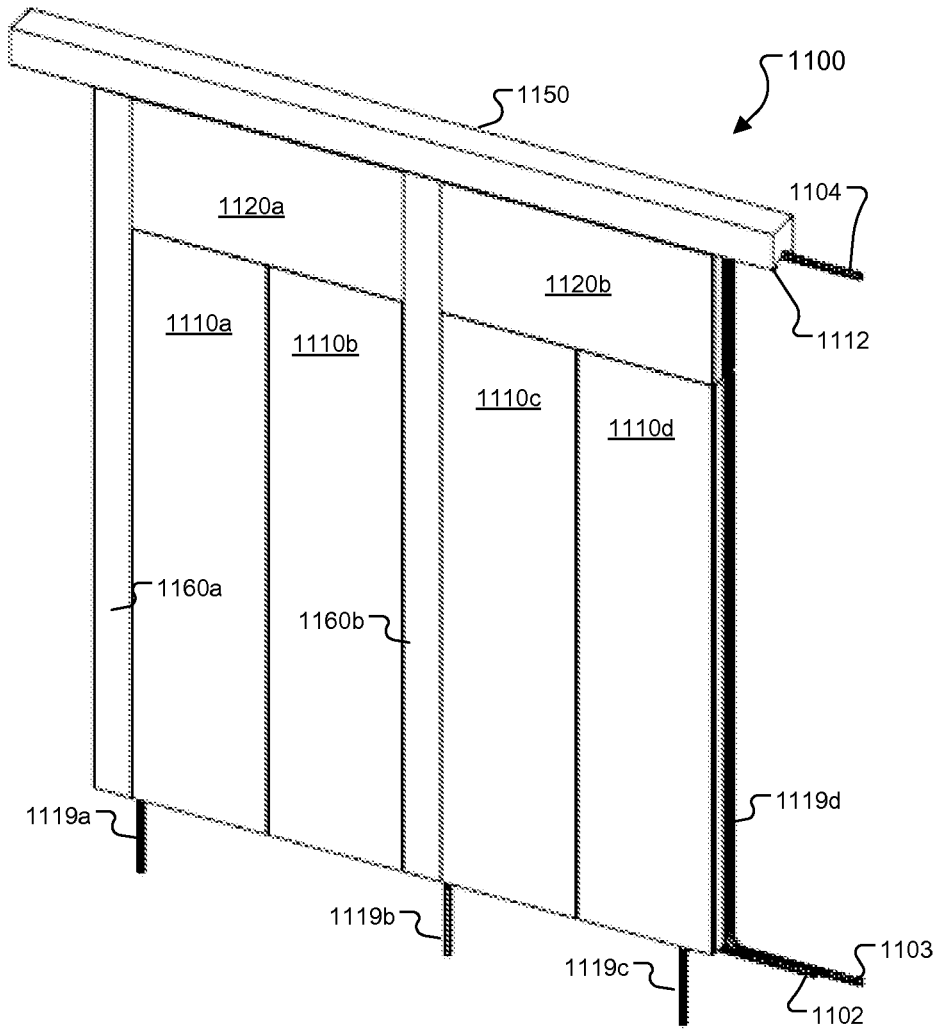
FIG. 11 is a perspective view of a wall constructed using precast concrete panels and posts according to another embodiment.

FIG. 11 is a perspective view of a wall 1100 constructed using precast panels 1110*a-d* and 1120*a-b*, and reinforcing columns 1160*a-b* according to another embodiment. Panels 1110*a-d* and 1120*a-b* may be similar to panels 10*a-d* and 20 described above. Wall 1100 is assembled in manner described above in connection with FIGS. 1-4 with reinforcement bars 1119*a-c* employed extending downward in position to extend into a foundation (the foundation not shown in this view). Panels 1120*a-b* are assembled atop panels 1110*a-d* to complete the wall height. In this embodiment, the panels 1120*a-b* may have a first type connector similar to connector 11 shown in FIG. 3 formed along the panel top edge them facilitate a tongue and groove connection according to the present invention with horizontal beam 1150 which may be similar to beam 56 shown in FIG. 5 with a second type connector 1112 (similar to connector 12 in FIG. 3, for example) formed in the concrete along the bottom edge of the beam. Wall 1100 also includes two columns 1160*a* and 1160*b* which may be similar to the column 60 described above in connection with FIG. 6. Column 1160*b* may include a first type connector similar to connector 11 in FIG. 3 along an edge opposing panel 1110*c*, and a second type connector similar to connector 12 in FIG. 3 along an edge opposing panel 1110*b*. Column 1160*a* may have a similar edge connector configuration. Of course, these edge connectors on the columns 1160*a-b* are not visible in the perspective of FIG. 11.

FIG. 11 illustrates one of numerous different configurations of reinforcement bar within the scope of the present invention. Reinforcement bars 1119*a* and 1119*b* may comprise bars that extend from the position exposed in the perspective of FIG. 11 upwardly in a connection cavity (similar to cavity 13*a* in FIG. 3) formed between the near side of the respective column 1160*a-b* and perhaps all the way up to a bend around the upper left corner of panel 1110*c*. This reinforcement bar arrangement is similar to the arrangement of reinforcing bars 19*a-d* shown in FIGS. 2A and 2B. Reinforcing bar 1119*c* in FIG. 11 does not extend vertically through a vertically extending edge connector cavity, but rather includes a 90 degree bend obscured by the lower edge of panel 1110*d* in this view, with a portion 1102 extending in the space provided by an edge connector formed along the bottom edge of panel 1110*d*. This edge connector may comprise a connector similar to second type connector 12 shown in FIG. 3. The vertical reinforcement provided along the near lateral edge of panel 1110*d* in FIG. 11 is provided by C-shaped reinforcement bar 1119*d* which includes 90 degree bends at its upper and lower ends to provide horizontal portions 1103 and 1104. It should also be noted that reinforcement bar 1119*d* extends vertically from the bottom edge of panel 1110*d* to the top edge of panel 1120*b*. This is in contrast to the embodiment described above in connection with FIGS. 2A and 2B in which the vertical reinforcing bars along the panel lateral edges terminated in the respective cavity formed along the top edge of the respective vertically oriented panel. A reinforcing bar similar to 1119*d* may be included in the edge connector cavity formed between the opposing edges of panel 1110*b* and column 1160*b*, and/or between the opposing edges of panel 1110*c* and column 1160*b*. Alternatively to the reinforcing bar 1119*d* spanning both panels 1110*d* and 1120*b* in FIG. 11, the reinforcing bar may extend up to and bend around a panel corner at the top edge of panel 1110*d*, and a separate piece of reinforcing bar may extend vertically along the near lateral edge of panel 1120*b*. This or any reinforcing bar used in a panel system according to the present invention may be bent in a C-shape, S-shape (a vertical section with a 90 degree bend one direction at one end and the opposite direction at the opposite end), L-shape, or any other shape to provide the desired reinforcement in the various edge connection cavities formed in the panel system. The edge connector cavity provided by the panel system of the present invention facilitates numerous different reinforcement bar configurations to meet the desired structural needs. Furthermore, some implementations of a panel system according to the present invention may use separate lengths of overlapping reinforcing bar in a given edge connection cavity to provide the desired reinforcement along that edge connection. In some cases where the lengths of different reinforcing bar overlap, it may be possible and desirable to connect the separate bars together by tying with wire, by adhesives, by welding, or by any suitable connection technique. For example, reinforcing bar portions 1102 and 1103 in FIG. 11 may be connected together prior to adding additional panels or other elements of the desired assembly.

It is noted that the edge connector comprising a second type connector 12 (FIG. 3) along the bottom of panels 1110*a-d* as shown forms a cavity between grooves of the connector and the flat foundation underneath. The groove (or dual groove as shown in FIG. 3) inside the base plane of the connector, this second type connector itself forms a cavity large enough to enclose at least two side-by-side lengths of reinforcing bar. In some preferred embodiments the second type edge connector similar to connector 12 in FIG. 3 is sized in a 4 inch thick panel to allow two side-by-side lengths of #4 rebar to fit in the connector groove facing a flat surface such as the flat surface of a foundation or floor structure. Such a construction presents not only the structural advantage of the tongue and groove connection where it is used, but also the advantage of using the same precast second connector type structure 12 as described above in connection with FIG. 3 to connect panels to flat surfaces.

Figure 12:
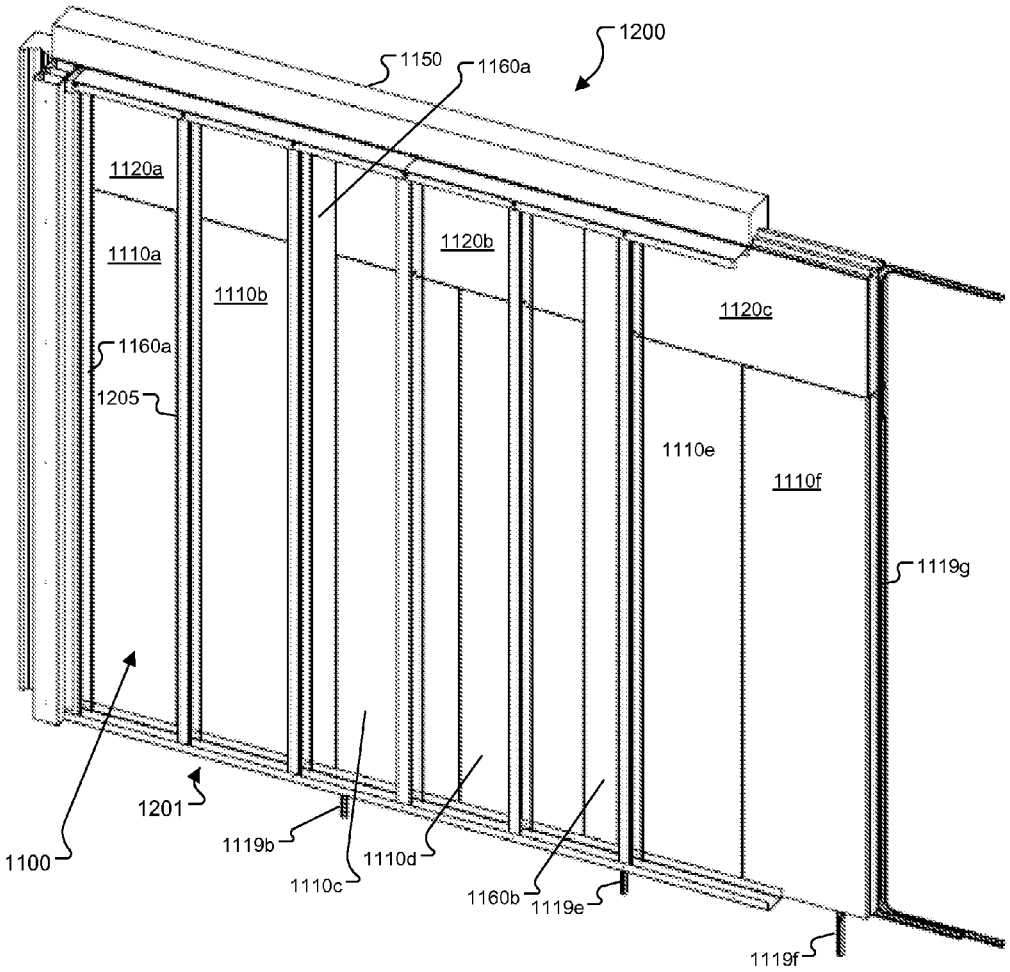
FIG. 12 a perspective view of a hybrid wall constructed using a frame structure in addition to the precast panels and posts of the embodiment of FIG. 11.

FIG. 12 is a perspective view of a wall 1100 to which additional concrete panels and columns have been added, and to which a steel frame wall structure 1201 has also been added to produce a hybrid wall 1200. In particular, the concrete panel portion of wall 1200 includes additional panels 1110*e*, 1110*f*, and 1120*c*, along with additional reinforcing bars 1119*e*, 1119*f*, and 1119*g*. Frame structure 1201 may comprise any suitable framing structure. Although steel framing elements, including vertical elements or studs 1205 are shown, other hybrid wall implementations may include wood framing elements. Steel or wood framing may be constructed in any suitable fashion. One preferred hybrid wall arrangement including frame structure 1201 may employ framing panels such as those disclosed in U.S. patent application Ser. No. 14/065,288 and U.S. patent application Ser. No. 14/065,303 to produce the frame structure. The entire content of each of these pending applications is incorporated herein by this reference.

The steel frame structure 1201 is built at the interior side of a panel wall 1100, although other implementations may place the framed wall to the exterior of the concrete panel wall. In either case, such hybrid construction provides the advantages of the structural characteristics of each type of wall, the concrete panel assembly according to the present invention, and the framed wall structure. This hybrid wall arrangement may allow the use of precast concrete panels for the exterior or interior walls in areas where framing is required by building codes. The precast panel wall 1100 may be connected to the frame structure 1201 with connectors which are shown FIGS. 13 and 14.

Figure 13:
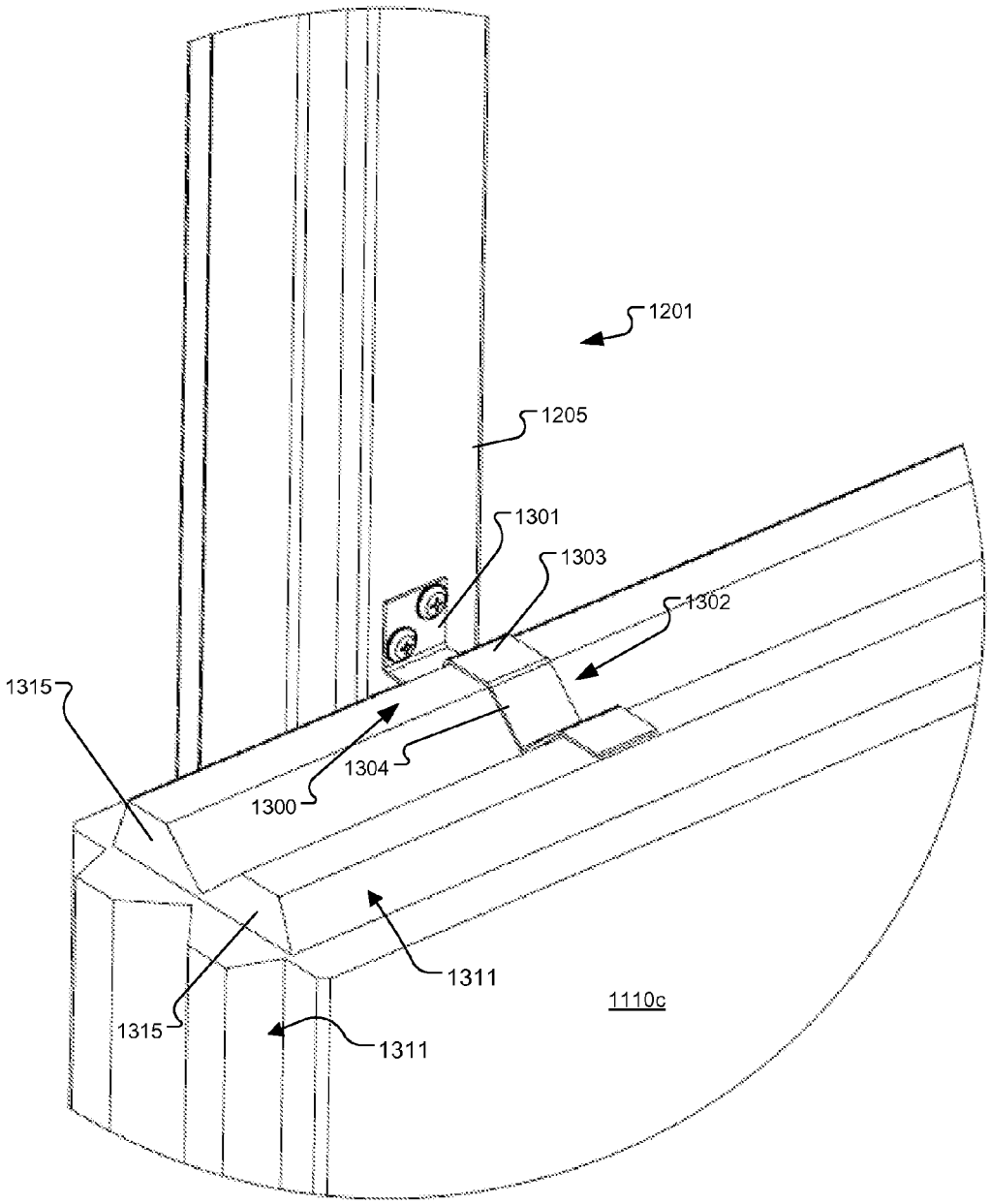
FIG. 13 is a perspective view showing a connector for attaching a concrete panel to a steel frame wall structure.
Figure 14:
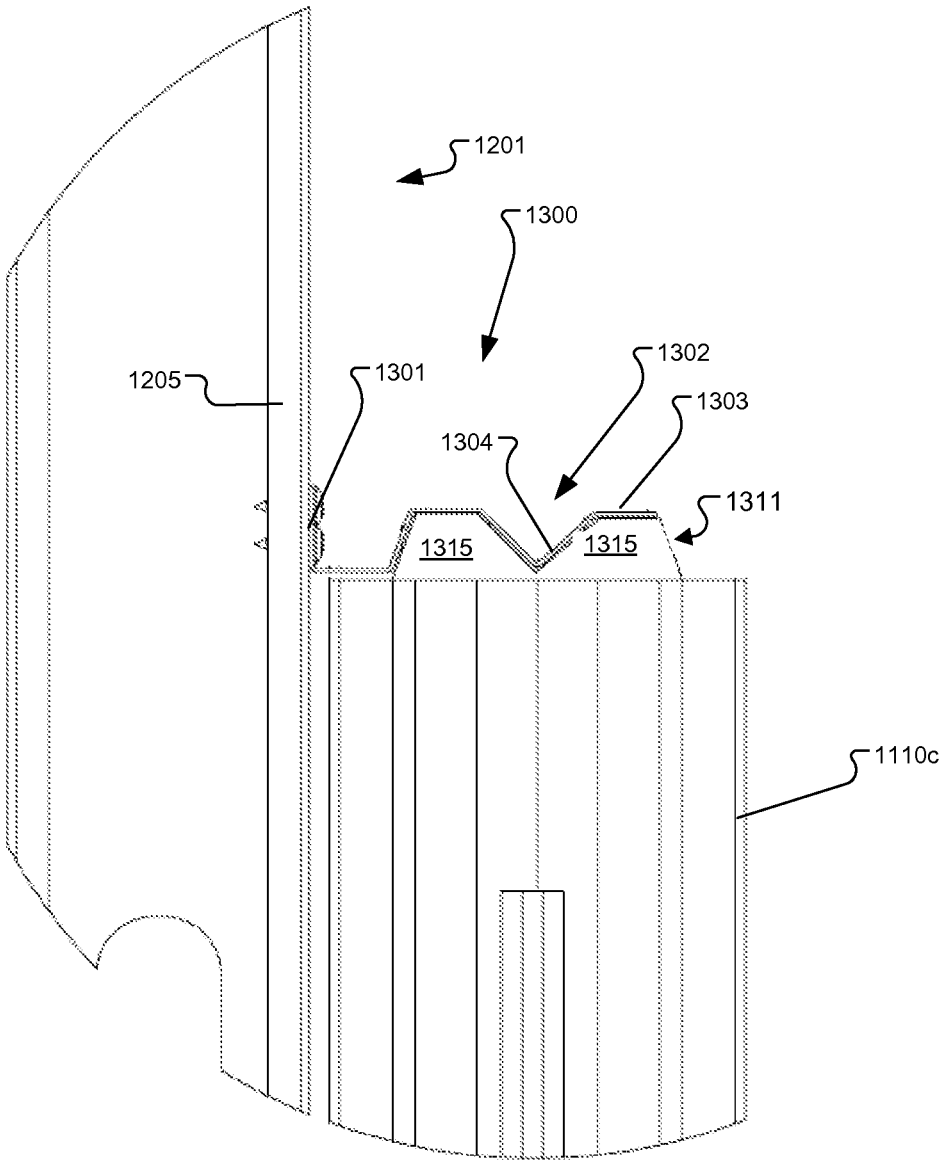
FIG. 14 is a side view of the concrete panel connector of FIG. 13.

Referring to FIGS. 13 and 14, frame connector 1300 is adapted to cooperate with a panel edge connection according to the present invention to provide a robust structural connection between the frame structure 1205 and the concrete panel wall. FIGS. 13 and 14 show connector 1300 in a partially installed condition between frame structure 1201 and one of the concrete panels shown in FIG. 12, particularly panel 1110*c*. Frame connector 1300 includes a frame attachment part 1301 and a panel attachment part 1302 that includes parts 1303 that are adapted to abut the distal ends of panel connector ridges 1315, and a V-shaped part 1304 adapted to abut the V-shaped surface formed in the panel connector 1311 between ridges 1315. Frame connector 1300 may be formed from any suitable material, including a suitable sheet steel similar to that from which the steel framing members are produced. The profile of frame connector 1300 needed to follow the shape of the panel connector 1311 in FIGS. 13 and 14 may also be formed in any suitable fashion. For example, sheet metal may be stamped to form the desired profile shown best in FIG. 14. Any suitable fasteners or fastening technique may be used to connect frame connector 1300 to the frame structure. FIGS. 13 and 14 show sheet metal screws through attachment part 1301 and into framing member 1205. Of course, once an additional panel is placed in a connected position with connector 1311 of panel 1110*c*, the panel attachment part 1302 will be securely connected to the panel assembly. It will be appreciated from the view of FIG. 14 that the V-shaped part 1304 fits in the V-shaped channel between ridges 1315 so that it does not substantially interfere with the function of the cavity (13 in FIG. 3) formed partially by the channel. That is, the installed frame connector 1300 does not interfere with the placement of one or more reinforcing bars in the cavity formed in the edge connection. The frame connectors 1300 are preferably installed by constructing the frame wall structure 1201 first, and then assembling the precast panel wall outside the frame structure. As the panels are placed in position with an exposed edge connector, the frame connectors are attached to the frame structure in position in the exposed edge connector (the position shown in FIGS. 13 and 14 for example) prior to placing the next panel in the connected position with that exposed edge connector. Although FIGS. 13 and 14 show frame connector 1300 in a horizontal panel connector, the frame connectors may be placed in any connection, horizontal or vertical, whether between panels or columns, or any other element including an edge structure according to the present invention.

The present invention encompasses a number of variations in the illustrated frame connector 1300 and its connection to a frame wall. For example, a frame connector may include a panel attachment part that does not extend all the way across the V-shaped or other cavity making up the edge connection cavity. In one alternative embodiment, the panel attachment part corresponding to part 1302 in FIGS. 13 and 14 may extend only to the top of the first ridge 1315 and may include no portion that follows the edge connection cavity profile of the given edge connection. Also, frame connectors such as connector 1300 in FIGS. 13 and 14 need not attach to any particular part of the frame wall. For example, rather than attaching to a framing member comprising a stud of the framed wall, the frame connector may be attached to a horizontal or other rail connected to or between studs in the framed wall.

Figure 15:
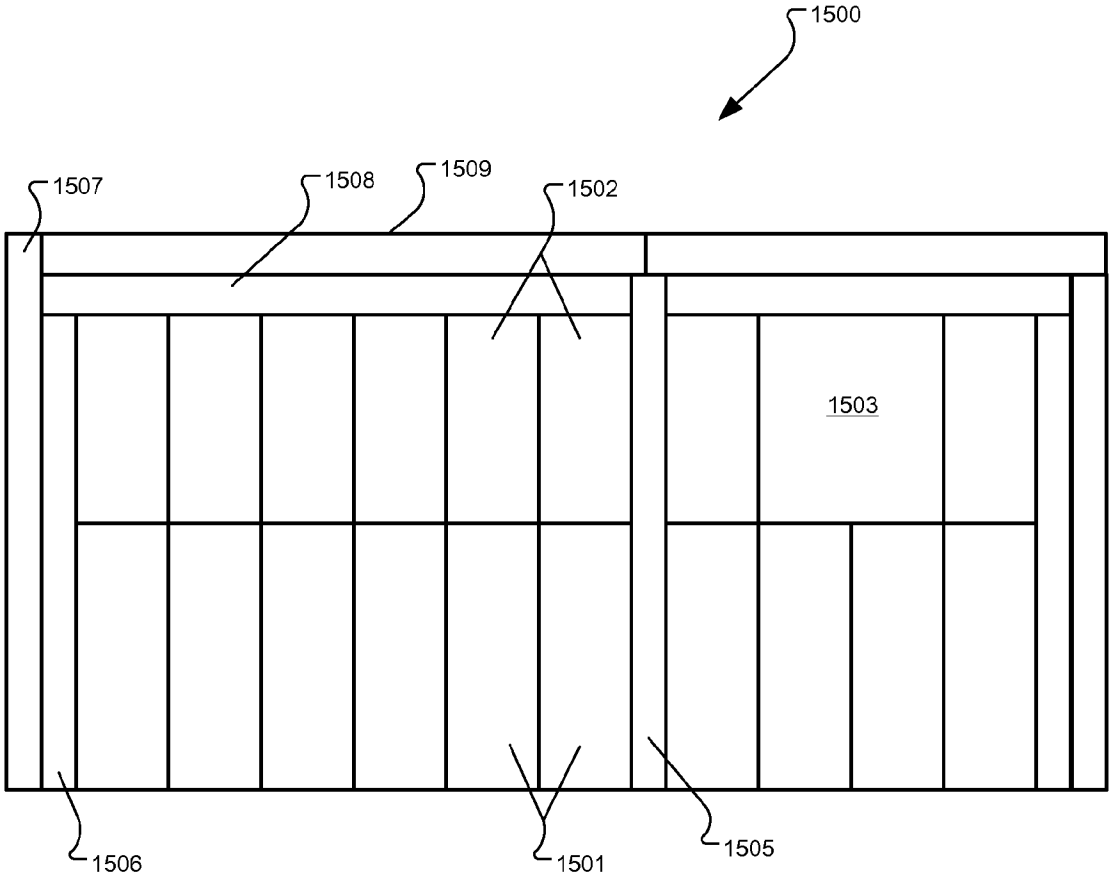
FIG. 15 is a diagrammatic representation of a wall structure that may be produced from concrete panels according to the present invention.

FIG. 15 comprises another example wall 1500 produced using concrete panels, posts, columns, and beams with edge connectors as described above. The illustrated structural base panels 1501 may be 46 inches tall by 16 inches wide, while the structural top panels 1502 may be 36 inches tall by 16 inches wide. This panel size arrangement allows two or more of the top panels to be left out of the structure to produce a window rough in 1503. The base panels 1501 below the window rough in 1503 may be removed to provide a rough in for a door rather than the illustrated window rough in. The wall column 1505, end column 1506, and corner column 1507 may or may not be structural. The base beam 1508 and top beam 1509 complete the height of the wall structure. These beams are preferably structural elements. All of these elements preferably include edge connectors as described above to facilitate the assembly with the edge connector cavities reinforcing bar placements as described above.

As can be understood from the disclosure herein, the techniques described create a panel construction system that can be employed to create a variety of structures. The most basic are single walls or a fully enclosed cube structure without windows. Other applications can create a structure using the panels to make a fully enclosed cube and having at least one pair of panels making a window receiving area and one pair of panels making a door receiving area. Yet another application is to assemble the pre-cast panels as described using the first and second type connectors when placing the panels as floor material, eliminating the need to cast a floor and much of the time involved. A further application is to use the panels as a second story floor material to build a level on top of an existing structure.

Still other techniques may be used to improve structural strength in the context the various applications that use panels as a roof structure and floor structure (grade supported or otherwise). Using the connector techniques described herein to provide reinforcing bars and stability as desired, precast panels may be made with a strength or density taking into account the desired application, but using the same construction techniques, by employing the ability at the precast stage to alter product density through changes in the mix design. Different densities that relate to required strengths can be achieved with ease, creating various product applications from the same mold.

The advantages of the present invention include, without limitation, a panelized concrete building method that improves upon concrete block construction by eliminating excessive mortar joints. It improves upon existing large concrete panel systems by utilizing lightweight materials that can create panels which are easy installed by two persons without heavy machinery. It improves upon existing smaller panel systems by eliminating the need for reinforcement cast within the panel itself. Additionally, the invention provides versatility in product configurations in regard to thicknesses, lengths, densities, surface textures and cast-in utilities.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A concrete panel system for assembly with reinforcing bars to produce a building component, the concrete panel system comprising:

(a) a first rectangular precast concrete panel defining a respective top edge, a bottom edge, and first and second lateral edges;

(b) a second rectangular precast concrete panel defining a respective top edge, a bottom edge, and first and second lateral edges;

(c) a third rectangular precast concrete panel defining a respective top edge, a bottom edge, and first and second lateral edges;

(d) a first type connector formed in the concrete material along the top edge of the first panel and along the first lateral edge of the first panel;

(e) a second type connector formed in the concrete material along the second lateral edge of the second panel and along the bottom edge of the third panel; and (f) the first type connector and the second type connector being configured so that when the first type connector along the first lateral edge of the first panel is placed in a connected position with the second type connector along the second lateral edge of the second panel, and the first type connector along the top edge of the first panel is placed in the connected position with the second type connector along the bottom edge of the third panel, a cavity is formed between the respective panel edges, the cavity extending along both the top edge of the first panel and the first lateral edge of the first panel, the portion of the cavity extending along the first lateral edge of the first panel being adapted to receive a lower portion of a first reinforcing bar with an upper portion bent at approximately 90 degrees to the lower portion so as to extend either along the top edge of the second panel or in the portion of the cavity extending along the top edge of the first panel.

2. The concrete panel system of claim 1 wherein the second panel includes the first type connector formed in the concrete material along the top edge thereof and the cavity extending along the top edge of the first panel is adapted to receive a length of second reinforcing bar extending parallel to and overlapping with the upper portion of the first reinforcing bar.

3. The concrete panel system of claim 2 wherein when the first type connector along the first lateral edge of the first panel is placed in the connected position with the second type connector along the second lateral edge of the second panel and the first type connector along the top edge of the first panel is placed in the connected position with the second type connector along the bottom edge of the third panel, the bottom edge of the third panel is adapted to extend along the top edge of the second panel so that the first type connector formed along the top edge of the second panel resides in the connected position with the second type connector along the bottom edge of the third panel to form a cavity between the respective panel edges and extending along the top edge of the second panel.

4. The concrete panel system of claim 1 wherein the first type connector comprises two spaced-apart ridges protruding from a base plane of the first type connector at the respective panel edge in which the first type connector is formed, the two spaced apart ridges defining a first type connector channel there between, and wherein a respective cavity defined between adjacent panels in the connected position is formed in part by surfaces of the first type connector channel.

5. The concrete panel system of claim 4 wherein the entire first type connector channel resides outside the first type connector base plane.

6. The concrete panel system of claim 4 wherein the second type connector formed in a respective panel edge comprises a groove recessed inside a base plane of the second type connector.

7. The concrete panel system of claim 6 wherein the second type connector groove comprises a first shallow groove and a second deep groove formed along an interior of the first shallow groove, and wherein a respective cavity defined between adjacent panels in the connected position is formed in part by surfaces of the second deep groove.

8. A concrete panel assembly comprising:

(a) a first rectangular precast concrete panel positioned in an assembly plane and defining a respective top edge, a bottom edge, and first and second lateral edges, the first panel having a first type connector formed from the concrete material along the top edge thereof and along the first lateral edge thereof;

(b) a second rectangular precast concrete panel positioned in the assembly plane and defining a respective top edge, a bottom edge, and first and second lateral edges, the second panel having the first type connector formed in the concrete material along the top side thereof and a second type connector formed in the concrete material along the second lateral edge thereof;

(c) a third rectangular precast concrete panel defining a respective top edge, a bottom edge, and first and second lateral edges, the third panel having the second type connector formed in the concrete material along the bottom edge thereof;

(d) wherein the first panel is positioned adjoining the second panel with the first type connector along the first lateral edge of the first panel in a connected position with the second type connector along the second lateral edge of the second panel, and the third panel is positioned adjoining both the first and second panels with the second type connector along the bottom edge of the third panel in the connected position with the first type connector along the top edge of the first panel and the first type connector along the top edge of the second panel;

(e) a respective edge cavity is formed between the respective adjoined panel edges, so that a respective edge cavity extends along the top edge of the first panel, the top edge of the second panel, and the first lateral edge of the first panel, and a corner cavity is formed at the junction between the first lateral edge of the first panel and the second lateral edge of the second panel with the bottom edge of the third panel;

(f) a length of first reinforcing bar extends along at least a portion of the cavity formed between the first and second panels and is bent at approximately 90 degrees so as to traverse the corner cavity and extend parallel to the top edge of the first panel along at least a portion of the length of the first reinforcing bar; and (g) wherein at least a portion of each respective edge cavity is filled with encasement material and at least a portion of each adjoined edge has an adhesive material applied thereon.

9. The concrete panel assembly of claim 8 wherein the first type connector comprises two spaced-apart ridges protruding from a base plane of the first type connector at the respective panel edge in which the first type connector is formed, the two spaced apart ridges defining a first type connector channel there between, and wherein a respective cavity defined between adjacent panels is formed in part by surfaces of the first type connector channel.

10. The concrete panel assembly of claim 9 wherein the second type connector formed in a respective panel edge comprises a groove recessed inside a base plane of the second type connector, the groove comprising a first shallow groove and a second deep groove formed along an interior of the first shallow groove, and wherein a respective cavity defined between adjacent panels in the connected position is formed in part by surfaces of the second deep groove.

11. A method of constructing a concrete building module, the method comprising:

(a) placing a first precast rectangular concrete panel in an assembly plane, the first panel having a top edge, a bottom edge, and first and second lateral edges, with a first type connector formed in the concrete material along the first lateral edge and top edge;

(b) placing a second precast rectangular concrete panel in the assembly plane in a position aligned with the first panel, the second panel having a top edge, a bottom edge, and first and second lateral edges, with a second type connector formed in the concrete material along the second lateral edge of the second panel;

(c) connecting the first and second panels such that the first type connector at the first lateral edge of the first panel and the second panel second type connector are in a connected position forming a first cavity between the respective panel edges;

(d) placing a first reinforcing bar into the first cavity, the reinforcing bar being bent at approximately 90 degrees so that a portion of the reinforcing bar extends parallel to the top edge of the first panel;

(e) placing a third precast rectangular concrete panel in the assembly plane in a position at least partially atop the first panel, the third panel having a top edge, a bottom edge, and first and second lateral edges, with a second type connector formed in the concrete material along the bottom edge of the third panel;

(f) connecting the first and third panels such that the first type connector at the top edge of the first panel and the second type connector at the bottom edge of the third panel are in a connected position forming a second cavity between the respective panel edges;

(g) placing a second reinforcing bar in the second cavity with a portion of the second reinforcing bar overlapping with a portion of the first reinforcing bar extending parallel to the top edge of the first panel;

(h) applying encasement material in the first cavity; and (i) applying encasement material in the second cavity.

12. The method of claim 11 further comprising setting the first reinforcing bar into a floor assembly prior to placing the first reinforcing bar in the first cavity.

13. The method of claim 11 in which the first type connector comprises two spaced-apart ridges extending outside a base plane of the first type connector at the respective edge on which the first type connector is formed, with a channel formed between the two ridges.

14. The method of claim 13 in which the first type connector channel resides outside the first type connector base plane.

15. The method of claim 13 in which the second type connector comprises a groove formed in the respective edge on which the second type connector is formed.

16. The method of claim 15 in which the second type connector groove is formed with a first shallow groove and a second deep groove formed along the interior of the first shallow groove.

17. The method of claim 15 in which the second type connector second groove has walls that, with opposing walls of the first connector type channel, form the respective first and second cavities.

18. The method of claim 11 in which connecting the first and second panels includes applying an adhesive along respective adjacent edges of the two panels external to the surfaces defining the first and second cavities.

19. The method of claim 11 further comprising placing an additional reinforcing bar in the first cavity in at least a partially overlapping fashion next to the first reinforcing bar.

20. The method of claim 11 wherein the encasement material is applied to the first cavity after connecting the first and second panels.

* * * * *